US011391103B2

(12) United States Patent
Zhao et al.

(10) Patent No.: US 11,391,103 B2
(45) Date of Patent: Jul. 19, 2022

(54) MONITORING, PREVENTION AND MANAGEMENT METHOD FOR PREVENTING DRILLING PUMP FROM PUMP SUFFOCATION AND MISOPERATION, AND PUMP PRESSURE PROTECTION SYSTEM THEREFOR

(71) Applicant: Puyang Baifu Reide Petroleum Science and Technology Company Limited, Puyang (CN)

(72) Inventors: Gang Zhao, Puyang (CN); Chen Chen, Tianjin (CN); Jianfeng Jin, Puyang (CN); Zhitao Zhang, Puyang (CN); Chun Yu, Puyang (CN); Yulong Xia, Puyang (CN); Yingdong Zhang, Puyang (CN)

(73) Assignee: Puyang Baifu Reide Petroleum Science and Technology Company Limited, Puyang (CN)

( * ) Notice: Subject to any disclaimer, the term of this patent is extended or adjusted under 35 U.S.C. 154(b) by 62 days.

(21) Appl. No.: 17/258,126

(22) PCT Filed: Jul. 3, 2019

(86) PCT No.: PCT/CN2019/094455

§ 371 (c)(1),
(2) Date: Jan. 5, 2021

(87) PCT Pub. No.: WO2020/007309

PCT Pub. Date: Jan. 9, 2020

(65) Prior Publication Data

US 2021/0317712 A1 Oct. 14, 2021

(30) Foreign Application Priority Data

Jul. 5, 2018 (CN) ..... 201810732053.0
Sep. 10, 2018 (CN) ..... 201811049380.2

(51) Int. Cl.
*E21B 21/08* (2006.01)
*E21B 21/10* (2006.01)
*E21B 47/06* (2012.01)

(52) U.S. Cl.
CPC ..... *E21B 21/08* (2013.01); *E21B 21/10* (2013.01); *E21B 21/106* (2013.01); *E21B 47/06* (2013.01)

(58) Field of Classification Search
CPC ..... E21B 21/08; E21B 21/106; E21B 47/06; E21B 21/01; E21B 21/10; F04B 49/06; F04B 49/10; F04B 51/00
See application file for complete search history.

(56) References Cited

U.S. PATENT DOCUMENTS

2011/0042076 A1* 2/2011 Reitsma ..... E21B 21/08 166/250.01
2015/0233197 A1* 8/2015 Oy ..... E21B 21/08 700/282

(Continued)

FOREIGN PATENT DOCUMENTS

CN 102220965 A 10/2011
CN 202091167 U 12/2011

(Continued)

OTHER PUBLICATIONS

ISA China National Intellectual Property Administration, International Search Report Issued in Application No. PCT/CN2019/094455, dated Aug. 23, 2019, WIPO, 4 pages.

*Primary Examiner* — Brad Harcourt
(74) *Attorney, Agent, or Firm* — McCoy Russell LLP

(57) ABSTRACT

Disclosed are a monitoring, prevention and management method for preventing a drilling pump from pump suffocation and misoperation, and a pump pressure protection system therefor. The monitoring method may comprise (Continued)

mounting a standpipe pressure sensor on a standpipe for detecting the pressure inside the standpipe; mounting a pump pressure sensor on a discharge line of the drilling pump for detecting the pressure of the drilling pump; setting a judgement constant N according to the average value of the difference between mud pressure in the pipelines upstream and downstream of a high-pressure valve in a normal operating condition; and at the start of the drill pump, comparing the mud pressure P1 in the pipeline upstream of the high-pressure valve and the mud pressure P2 in the pipeline downstream of the high-pressure valve in real time: if P1-P2≤N, the high-pressure valve is determined in an open state, and the drilling pump is operating normally; and if P1−P2>N, the high-pressure valve is determined in a closed state, and a pump suffocation occurs to the drilling pump. According to the method, whether the high-pressure valve is closed is determined by means of calculating and comparing the difference between upstream and downstream pressure of mud liquid using the pressure sensors, such that not only can a drilling pump be prevented from a pump seizure accident due to suffocation, but also a safety risk brought about by an ultra-high pump pressure of a drilling pump during drilling can be prevented by means of taking full advantages of the pressure sensors.

20 Claims, 3 Drawing Sheets

(56) References Cited

U.S. PATENT DOCUMENTS

| | | | | |
|---|---|---|---|---|
| 2016/0076322 | A1* | 3/2016 | Oddie | E21B 21/10<br>73/152.51 |
| 2018/0266198 | A1* | 9/2018 | Manum | E21B 21/08 |

FOREIGN PATENT DOCUMENTS

| | | | |
|---|---|---|---|
| CN | 203756485 | U | 8/2014 |
| CN | 104595168 | A | 5/2015 |
| CN | 108894969 | A | 11/2018 |
| JP | 2014101759 | A | 6/2014 |
| WO | 2018089299 | A1 | 5/2018 |

* cited by examiner

MONITORING, PREVENTION AND MANAGEMENT METHOD FOR PREVENTING DRILLING PUMP FROM PUMP SUFFOCATION AND MISOPERATION, AND PUMP PRESSURE PROTECTION SYSTEM THEREFOR

CROSS-REFERENCES TO RELATED APPLICATIONS

The present application is a U.S. National Phase of International Application No. PCT/CN2019/094455 entitled "MONITORING, PREVENTION AND MANAGEMENT METHOD FOR PREVENTING DRILL PUMP FROM PUMP SUFFOCATION AND MISOPERATION, AND PUMP PRESSURE PROTECTION SYSTEM THEREFOR", and filed on Jul. 3, 2019. International Application No. PCT/CN2019/094455 claims priority to Chinese Patent Application No. 201810732053.0 filed on Jul. 5, 2018 and Chinese Patent Application No. 201811049380.2 filed on Sep. 10, 2018. The entire contents of each of the above-listed applications are hereby incorporated by reference for all purposes.

TECHNICAL FIELD

The application relates to a safety control technology in petroleum drilling engineering, in particular to a monitoring, prevention and management method for preventing pump suffocation and misoperation of a drilling pump, and a pump pressure protection system therefor.

BACKGROUND AND SUMMARY

In the process of oil exploration, development and drilling, drilling pump is the key equipment to provide power for mud circulation, which operates at high pressure. According to the type of drilling pump and the diameter of cylinder liner, the general operating pressure of a drilling pump is 15-35 MPa. Taking an F-1600 drilling pump which is usually equipped on a 7000 m drilling rig as an example, the rated operating pressure is 23.1-34.5 MPa depending on the diameter of the cylinder liner. Under such high operating pressure, a safety valve is inevitably needed to ensure that the operating pressure of the drilling pump does not exceed the limit. At present, the safety valve used in the drilling pump in China is mainly a shear pin safety valve. Its working principle is that a high-pressure fluid acts on a bearing piston and is transmitted to a safety arm through a valve body. When the pressure exceeds a set safety value, a safety pin is sheared off and the fluid is discharged out of the valve, so as to achieve the effect of pressure relief. However, the disadvantages of the shear pin safety valve are as follows: first, it can only relieve pressure and cannot automatically stop the pump; second, the number of commonly used gears is few and there are only five gears from 14 MPa to 35 MPa; third, the error is large, generally 10%-15%, sometimes even higher.

In the process of drilling operation in China, one drilling rig is equipped with two drilling pumps. In the design of the discharge line of each drilling pump, a high-pressure valve and a low-pressure return water valve are generally equipped. If one of the two drilling pumps is faulted and needs to be repaired, the low-pressure return water valve of the faulted drilling pump is opened and its high-pressure valve is closed at the same time, so as to prevent high-pressure mud generated during operation of the other drilling pump from flowing into the drilling pump under maintenance and hurting the maintenance personnel. After the maintenance is completed, the high-pressure valve closed during maintenance must be opened first and then the low-pressure return water valve is closed under the condition of no pressure in a high-pressure pipeline before the drilling pump is allowed to restart.

However, in the actual drilling process, for example, due to the influence of human factors, there are often mistakes, resulting in a wrong operation of restarting the drilling pump without opening the high-pressure valve after the low-pressure return water valve is closed, and such wrong operation causes the pump pressure of the drilling pump to rise instantaneously and rapidly exceed the maximum operating pressure of the drilling pump, which leads to extreme pump suffocation (commonly known as "pump seizure due to suffocation"), which often results in personal injury or even pump destruction and personal death. According to the existing monitoring data, at the moment of extreme pump suffocation (commonly known as "pump seizure due to suffocation"), the pump pressure rises from 12 MPa to 40 MPa within only 1-2 seconds. In such a short period of time, the shear pin safety valve can neither determine whether the high-pressure and low-pressure valves are both closed in time due to its own defects, and can nor stop the pump to relieve pressure in time, so it cannot play the role of safety protection.

It is an essential requirement for safety production to prevent pump suffocation of the drilling pump. Therefore, a type of intelligent monitoring equipment is needed, which can determine whether there is a case of extreme pump suffocation (commonly known as "pump seizure due to suffocation") at the moment of starting the drilling pump.

In the patent application for invention titled "ELECTRIC CONTROL SAFETY SYSTEM FOR SLURRY PUMP" (patent application No.: 201110158925.5) and the patent application for utility model titled "ELECTRIC CONTROL SAFETY SYSTEM FOR SLURRY PUMP" (patent application No.: 201120199304.7) previously provided by the applicant of this application, a pressure sensor is mounted on a high-pressure pipeline of a drilling pump or a discharge line of the drilling pump, which is used cooperatively with a PLC, an AD converter, an industrial personal computer, a pressure relief valve and other equipment, and by adopting a method of stopping the pump to relieve pressure when the pump pressure exceeds a normal value, the potential safety hazard caused by pump suffocation when the pump pressure is ultra-high in drilling operation is effectively solved. However, this method cannot determine whether the high-pressure valve is closed, so it cannot solve the problem of pump suffocation yet.

The application solves the above problem in the prior art by providing a monitoring, prevention and management method for preventing pump suffocation and misoperation of a drilling pump, and a pump pressure protection system therefor.

In one aspect, the application provides a method for monitoring and judging pump suffocation of a drilling pump in petroleum drilling engineering, which can prevent the potential safety hazard caused when the pump pressure of the drilling pump is ultra-high during drilling by fully using pressure sensors, and is economic and applicable.

In one example, a method for monitoring and judging pump suffocation of a drilling pump in petroleum drilling engineering is provided, which includes mounting a pump pressure sensor on a pipeline connecting a discharge line of the drilling pump and a high-pressure valve for detecting mud pressure (i.e., pump outlet pressure) P1 (unit: MPa) in a pipeline upstream of the high-pressure valve; mounting a standpipe pressure sensor on a pipeline connecting the high-pressure valve and a standpipe for detecting mud pressure P2 (unit: MPa) in a pipeline downstream of the high-pressure valve; setting a judgement constant N (unit: MPa) according to the average value of the difference between the mud pressures in the pipelines upstream and downstream of the high-pressure valve under a normal operating condition; and at the start of the drilling pump, obtaining, by a controller, the mud pressure P1 in the pipeline upstream of the high-pressure valve and the mud pressure P2 in the pipeline downstream of the high-pressure valve, and comparing the mud pressure P1 and the mud pressure P2 in real time:

if $P1-P2 \leq N$, judging that the high-pressure valve is in an open state, and the drilling pump is able to operate normally, if $P1-P2 > N$, judging that the high-pressure valve is in a closed state, and the continuous operation of the drilling pump causes pump pressure to rise rapidly, resulting in the occurrence of pump suffocation.

In the method for monitoring and judging pump suffocation of the drilling pump in petroleum drilling engineering, the average value of the difference between the mud pressures in the pipelines upstream and downstream of the high-pressure valve under the normal operating condition is set as n (unit: MPa), and $1 \leq N-n \leq 3$ (unit: MPa) is set in combination with parameters of used drilling equipment.

In the method for monitoring and judging pump suffocation of the drilling pump in petroleum drilling engineering, when it is detected that the high-pressure valve is in the closed state and pump suffocation of the drilling pump occurs, an early warning is given in time.

In one example, the average value n of the difference between the mud pressures in the pipelines upstream and downstream of the high-pressure valve under the normal operating condition is generally greater than 0 and smaller than 1 MPa. The closer the distance of the mounting position of the standpipe pressure sensor to the high-pressure valve is, the smaller the average value n is.

In another example, a pump pressure protection system for preventing pump suffocation of a drilling pump in petroleum drilling engineering is provided, which includes a pump pressure sensor configured to detect mud pressure (i.e., pump outlet pressure) P1 (unit: MPa) in a pipeline upstream of a high-pressure valve; a standpipe pressure sensor configured to detect mud pressure P2 (unit: MPa) in a pipeline downstream of the high-pressure valve; a controller configured to obtain the mud pressure P1 in the pipeline upstream of the high-pressure valve and the mud pressure P2 in the pipeline downstream of the high-pressure valve and compare the mud pressure P1 and the mud pressure P2 in real time, wherein a judgement constant N is set according to the average value of the difference between the mud pressures in the pipelines upstream and downstream of the high-pressure valve under a normal operating condition: (1) if $P1-P2 \leq N$, judging that the high-pressure valve is in an open state, and the drilling pump operates normally, (2) if $P1-P2 > N$, judging that the high-pressure valve is in a closed state, and pump suffocation of the drilling pump occurs; a pressure relief valve connected to the pipeline upstream of the high-pressure valve and located between the drilling pump and a mud tank; and an actuating mechanism including a pneumatic control loop and a solenoid valve for operating the drilling pump and the pressure relief valve after receiving an instruction from the controller, wherein output pressure signals of the pump pressure sensor and the standpipe pressure sensor are optionally transmitted to the controller through an analog-digital (AD) converter, an output of the controller is then transmitted to the actuating mechanism, and the power of the pressure relief valve and the drilling pump is controlled through the actuating mechanism.

The pressure relief valve is preferably a pneumatic ball valve. The controller may be an industrial personal computer or a combination of an industrial personal computer and a Programmable Logic Controller (PLC). The solenoid valve is preferably a two-position five-way solenoid valve.

The pump pressure protection system adopts the above monitoring and judging system to identify the occurrence of pump suffocation of the drilling pump to stop the drilling pump for pressure relief through the pump pressure protection system of the drilling pump, so as to prevent pump suffocation of the drilling pump from occurring. Specifically, at the start of the drilling pump, the controller obtains the pump outlet pressure P1 and the mud pressure P2 in the pipeline downstream of the high-pressure valve, and compares the pump outlet pressure P1 and the mud pressure P2 in real time:

if $P1-P2 \leq N$, judging that the high-pressure valve is in an open state, and the drilling pump is able to operate normally. At this moment, what needs to be prevented is the problem that the pump pressure during drilling is ultra-high. Therefore, an upper limit P (unit: MPa) for pump pressure protection is set. If the pump outlet pressure P1 and/or the mud pressure P2 in the pipeline downstream of the high-pressure valve is greater than or equal to P, the pump pressure protection system of the drilling pump opens the pressure relief valve and correspondingly powers off the drilling pump;

if $P1-P2 > N$, judging that the high-pressure valve is in a closed state, and the continuous operation of the drilling pump causes pump pressure to rise rapidly, resulting in the occurrence of pump suffocation. At this moment, what needs to be prevented is the problem that the drilling pump is started without opening the high-pressure valve, so as to prevent a pump seizure accident due to suffocation from occurring. The controller starts the pump pressure protection system to open the pressure relief valve and correspondingly power off the drilling pump to stop the drilling pump for pressure relief, so as to prevent a pump seizure accident due to suffocation from occurring.

In another aspect, a method for preventing misoperation of a drilling pump in petroleum drilling engineering is provided, which, by comparing the pressure detected by a standpipe pressure sensor and the pressure detected by a pump pressure sensor, to achieve effectively prevention of the misoperation of the drilling pump, can avoid the potential safety hazard caused by the ultra-high pump pressure of the drilling pump due to misoperation. On this basis, the application provides a pump pressure protection system capable of preventing misoperation of a drilling pump, which not only can realize the pump pressure safety protection, but also can effectively prevent a misoperation accident from occurring during maintenance of the drilling pump.

In one example, a method for preventing misoperation of a drilling pump in petroleum drilling engineering is provided, which includes mounting a standpipe pressure sensor on a standpipe for detecting mud pressure P0 (unit: MPa) in the standpipe; mounting a first pressure sensor on a discharge line of a drilling pump I for detecting pressure P1 (unit: MPa) of the drilling pump I; mounting a second pressure sensor on a discharge line of a drilling pump II for detecting pressure P2 (unit: MPa) of the drilling pump II; setting the average value of the difference between mud pressures in pipelines upstream and downstream of a high-pressure valve under a normal operating condition as n (unit: MPa), and setting a judgement constant N in combination with parameters of used drilling equipment, wherein the judgement constant N satisfies $1 \leq N-n \leq 3$; at the start of the drilling pump, obtaining, by a controller, the mud pressure P0 in the standpipe, the pressure P1 of the drilling pump I and the pressure P2 of the drilling pump II, and comparing the mud pressure P0, the pressure P1 of the drilling pump I and the pressure P2 of the drilling pump II in real time:

if $P0-P1 \leq N$, or $P2-P1 \leq N$ and $P0-P1 \leq N$, judging that the high-pressure valve of the drilling pump I is in an open state, and the drilling pump I is able to start;

if $P0-P2 \leq N$, or $P1-P2 \leq N$ and $P0-P2 \leq N$, judging that the high-pressure valve of the drilling pump II is in an open state, and the drilling pump II is able to start;

if $P0-P1 > N$, or $P2-P1 > N$ and $P0-P1 > N$, judging that the high-pressure valve of the drilling pump I is in a closed state, and the controller controls (for example, cuts off) a control air path or circuit of the drilling pump Ito make the drilling pump I unable to start;

if $P0-P2 > N$, or $P1-P2 > N$ and $P0-P2 > N$, judging that the high-pressure valve of the drilling pump II is in a closed state, and the controller controls (for example, cuts off) a control air path or circuit of the drilling pump II to make the drilling pump II unable to start.

In another example, a pump pressure protection system for preventing misoperation of a drilling pump in petroleum drilling engineering is provided, which includes a standpipe pressure sensor configured to detect pressure P0 (unit: MPa) in a standpipe; pump pressure sensors including a first pressure sensor and a second pressure sensor, the first pressure sensor being configured to detect pressure P1 (unit: MPa) of a drilling pump I, and the second pressure sensor being configured to detect pressure P2 (unit: MPa) of a drilling pump II; a controller configured to obtain the pressure P0 in the standpipe, the pressure P1 of the drilling pump I and the pressure P2 of the drilling pump II; compare the mud pressure P0, the pressure P1 of the drilling pump I and the pressure P2 of the drilling pump II in real time, wherein the average value of the difference between mud pressures in pipelines upstream and downstream of a high-pressure valve under a normal operating condition is set as n (unit: MPa), a judgement constant N is set in combination with parameters of used drilling equipment, and the judgement constant N satisfies $1 \leq N-n \leq 3$: (1) if $P0-P1 \leq N$, or $P2-P1 \leq N$ and $P0-P1 \leq N$, judging that the high-pressure valve of the drilling pump I is in an open state, and the drilling pump I starts, (2) if $P0-P2 \leq N$, or $P1-P2 \leq N$ and $P0-P2 \leq N$, judging that the high-pressure valve of the drilling pump II is in an open state, and the drilling pump II starts, (3) if $P0-P1 > N$, or $P2-P1 > N$ and $P0-P1 > N$, judging that the high-pressure valve of the drilling pump I is in a closed state, and the controller controls (for example, cuts off) a control air path or circuit of the drilling pump I to make the drilling pump I unable to start, (4) if $P0-P2 > N$, or $P1-P2 > N$ and $P0-P2 > N$, judging that the high-pressure valve of the drilling pump II is in a closed state, and the controller controls (for example, cuts off) a control air path or circuit of the drilling pump II to make the drilling pump II unable to start; and an actuating mechanism including a pneumatic control system and a solenoid valve, or including an electric control loop and a start and stop control circuit and for operating the drilling pump I and the drilling pump II after receiving an instruction from the controller, wherein output pressure signals of the pump pressure sensor and the standpipe pressure sensor are optionally transmitted to the controller through an analog-digital (AD) converter, an output of the controller is then transmitted to the actuating mechanism, and the start and stop of the drilling pump I or the drilling pump II is controlled through the actuating mechanism, so as to prevent pump suffocation due to misoperation of the drilling pump from occurring.

In the example that the actuating mechanism includes a pneumatic control system and a solenoid valve, the controller outputs two loops of control signals which are respectively connected with a control solenoid valve of the drilling pump I and a control solenoid valve of the drilling pump II, and then are connected with clutch controllers of the drilling pumps through the solenoid valves.

In the example that the actuating mechanism includes an electric control loop and a start and stop control circuit, the controller outputs two loops of control signals which are respectively connected with a start and stop control circuit of the drilling pump I and a start and stop control circuit of the drilling pump II.

The controller may be an industrial personal computer or a combination of an industrial personal computer and a Programmable Logic Controller (PLC). The solenoid valve is preferably a two-position five-way solenoid valve.

The pump pressure protection system adopts the above monitoring and judging method to identify the occurrence of misoperation of the drilling pump to control the start and stop of the drilling pump I or the drilling pump II through the pump pressure protection system of the drilling pump, so as to prevent pump suffocation due to misoperation of the drilling pump from occurring. Specifically, at the start of the drilling pump, the controller obtains the pressure P0 in the standpipe, the pressure P1 of the drilling pump I and the pressure P2 of the drilling pump II, and compares the pressure P0, the pressure P1 of the drilling pump I and the pressure P2 of the drilling pump II in real time:

if $P0-P1 \leq N$, or $P2-P1 \leq N$ and $P0-P1 \leq N$, judging that the high-pressure valve of the drilling pump I is in an open state, and the drilling pump I is able to start;

if $P0-P2 \leq N$, or $P1-P2 \leq N$ and $P0-P2 \leq N$, judging that the high-pressure valve of the drilling pump II is in an open state, and the drilling pump II is able to start;

if $P0-P1 > N$, or $P2-P1 > N$ and $P0-P1 > N$, judging that the high-pressure valve of the drilling pump I is in a closed state, and the controller controls (for example, cuts off) a control air path or circuit of the drilling pump Ito make the drilling pump I unable to start;

if $P0-P2 > N$, or $P1-P2 > N$ and $P0-P2 > N$, judging that the high-pressure valve of the drilling pump II is in a closed state, and the controller cuts off a control air path or circuit of the drilling pump II to make the drilling pump II unable to start.

The Beneficial Effects of the Present Application:

The method for monitoring and judging pump suffocation of the drilling pump in petroleum drilling engineering provided by the application, by taking advantage of the characteristics that the mud liquid transfers pressure in the pipeline, determines whether the high-pressure valve is closed by using the pressure sensors to calculate and compare the difference between upstream and downstream pressures of the mud liquid, such that not only can the pump seizure accident due to suffocation be prevented from occurring in the drilling pump, but also the potential safety hazard caused when the pump pressure of the drilling pump is ultra-high during drilling can be prevented by sufficiently using the pressure sensors. The pump pressure protection system for preventing pump suffocation of the drilling pump provided by the application not only can realize the pump pressure safety protection, but also can effectively prevent the pump seizure accident due to suffocation from occurring in the drilling pump. The design is reasonable, the structure is simple, the cost of the system structure is not required to increase (only the mud pressure sensor P2 downstream of the high-pressure valve needs to be additionally provided), it is easy to realize, the popularization is facilitated, and the social benefit is better.

The method for preventing misoperation of the drilling pump in petroleum drilling engineering provided by the application, by taking advantage of the characteristics that the mud liquid transfers pressure in the pipeline, determines whether the high-pressure valve is closed by using the pressure sensors to calculate and compare the difference between upstream and downstream pressures of the mud liquid, such that not only can the pump misoperation accident be prevented from occurring in the drilling pump, but also the potential safety hazard caused when the pump pressure of the drilling pump is ultra-high during drilling can be prevented by sufficiently using the pressure sensors.

The pump pressure protection system for preventing misoperation of the drilling pump provided by the application not only can realize the pump pressure safety protection, but also can effectively prevent the pump misoperation accident from occurring in the drilling pump. The design is reasonable, the structure is simple, the cost of the system structure is not required to increase (only the mud pressure sensor downstream of the high-pressure valve needs to be additionally provided), it is easy to realize, the popularization is facilitated, and the social and economic benefits are better.

DETAILED DESCRIPTION OF THE FIGURES

Figure 1:
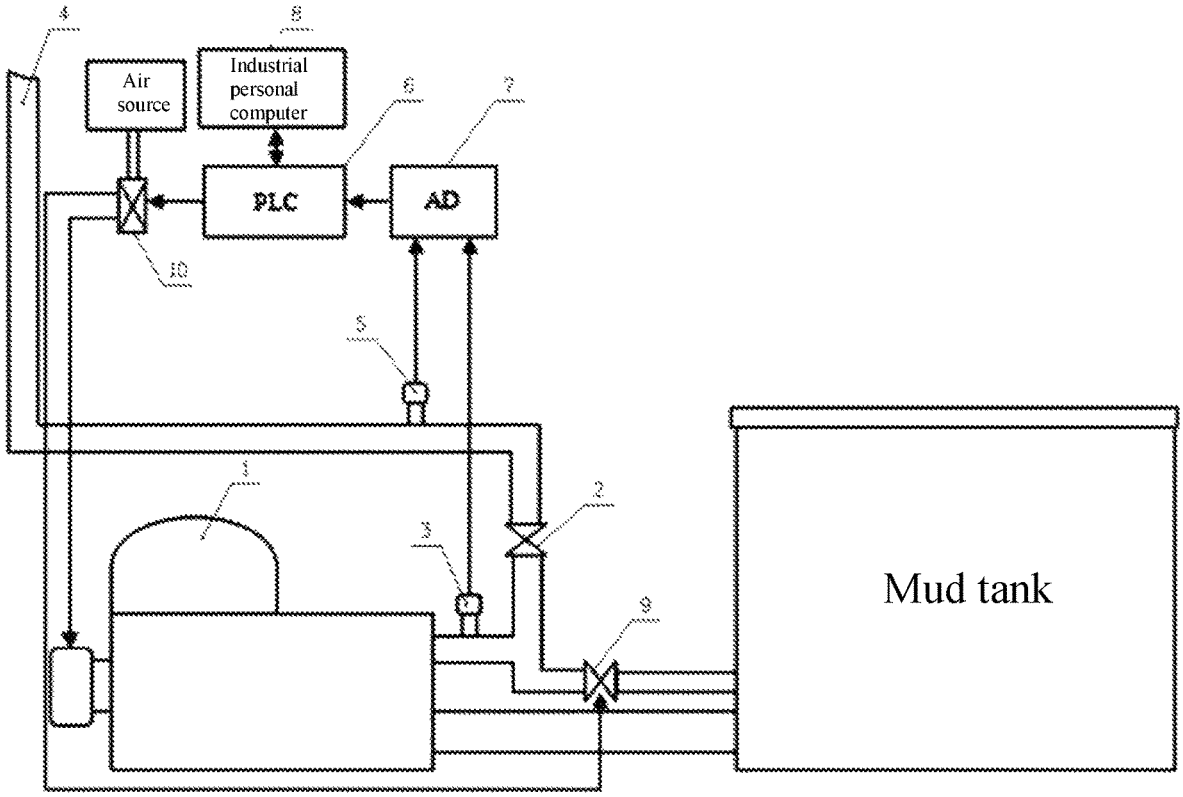
FIG. 1 is a structural schematic diagram of a pump pressure protection system for preventing pump suffocation of a drilling pump according to the application.
Figure 2:
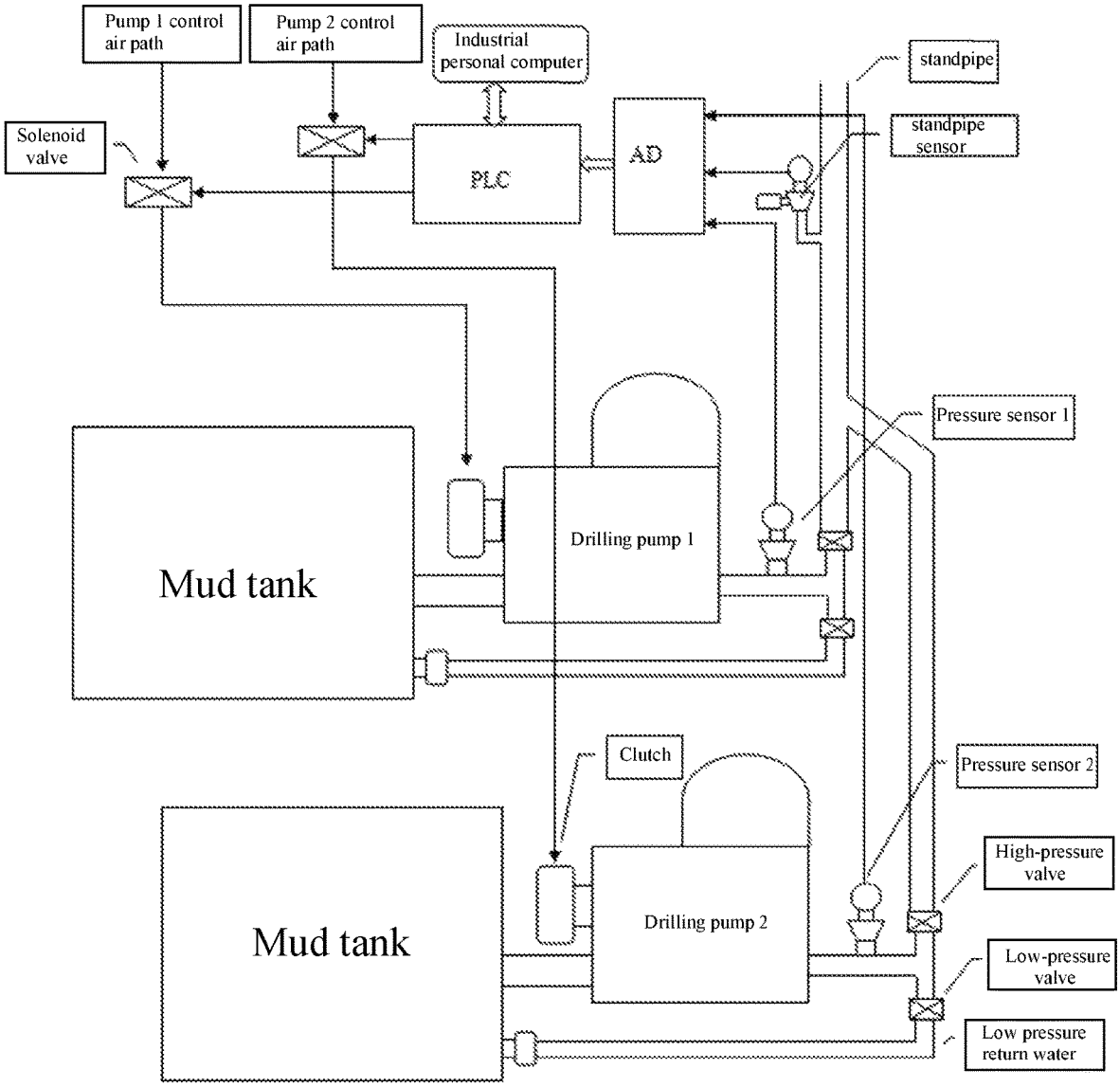
FIG. 2 is a structural schematic diagram of a pump pressure protection system for preventing pump suffocation of a drilling pump (mechanical drilling pump) according to the application.
Figure 3:
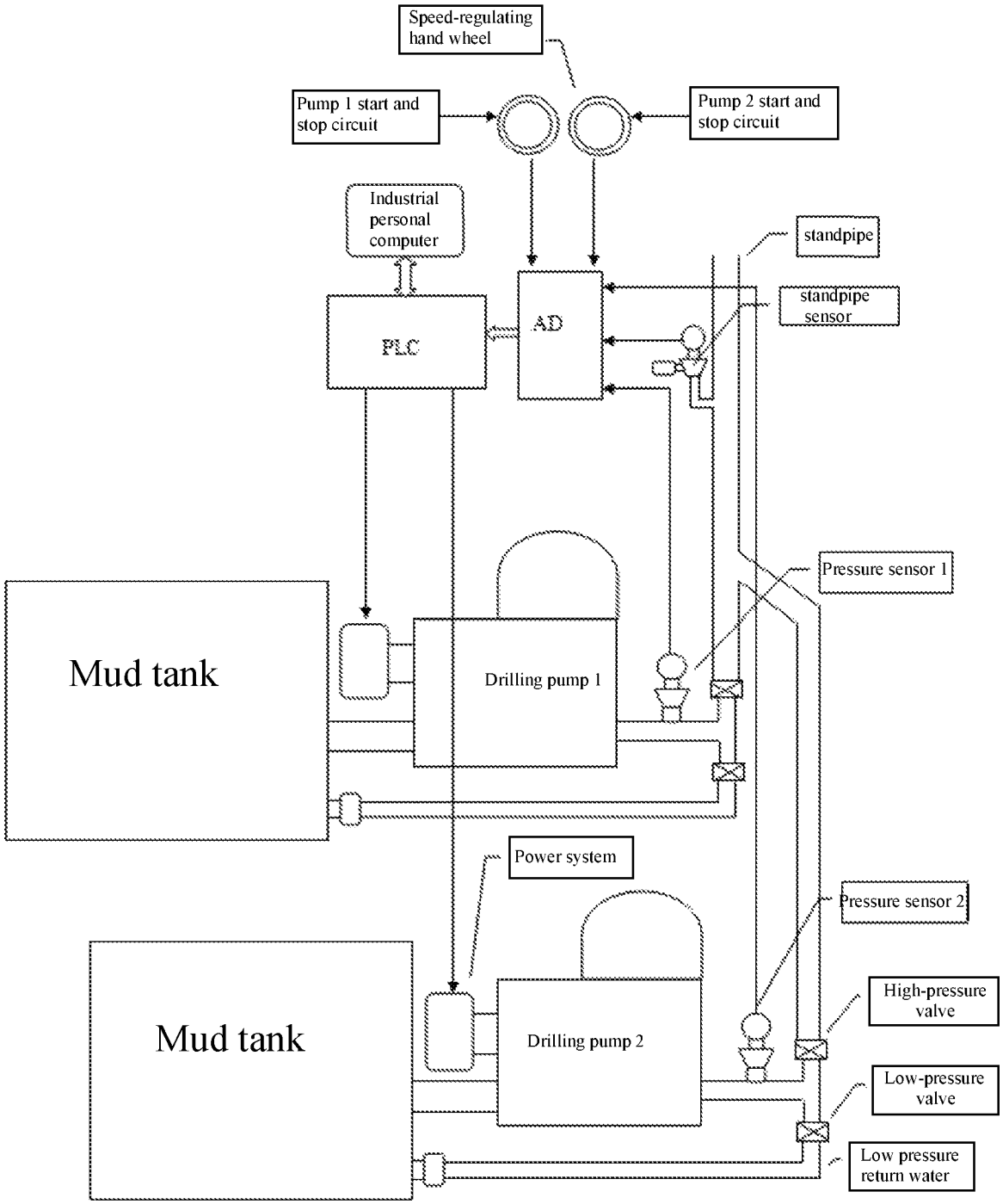
FIG. 3 is a structural schematic diagram of a pump pressure protection system for preventing pump suffocation of a drilling pump (electric drilling pump) according to the application.

Pump pressure will rise rapidly at the moment before the occurrence of extreme pump suffocation (commonly known as pump seizure due to suffocation). The rising process can be divided into the following two stages: the first stage is a period from the start of the pump to the moment that the pump pressure reaches 12 MPa, which is a starting stage and needs 1-2 seconds; the second stage is a period that the pump pressure rises from 12 MPa to 40 MPa or above, which is an accelerated rising stage and only needs 1-2 seconds. Therefore, early detection and early control is the premise to prevent the extreme pump suffocation (commonly known as pump seizure due to suffocation) from occurring. By using the monitoring and judging method and the pump pressure protection system provided by the application, the occurrence of pump suffocation can be determined in time at the first stage that the pump pressure rises from 0 MPa to 12 MPa, so as to stop the pump for pressure relief in time and prevent the pump seizure accident due to suffocation from occurring. FIG. 1 is a structural schematic diagram of a pump pressure protection system for preventing pump suffocation of a drilling pump according to one example of the application. FIG. 2 is a structural schematic diagram of a pump pressure protection system for preventing pump suffocation of a drilling pump (mechanical drilling pump) according to another example of the application. FIG. 3 is a structural schematic diagram of a pump pressure protection system for preventing pump suffocation of a drilling pump (electric drilling pump) according to another example of the application. The technical solution of the application will be further described below in detail through the specific embodiments.

EXAMPLE 1

The application provides a method for monitoring and judging pump suffocation of a drilling pump in petroleum drilling engineering, the implementation process of which includes the following steps:

1) mounting a pump pressure sensor on a pipeline connecting a discharge line of the drilling pump and a high-pressure valve for detecting mud pressure P1 (unit: MPa) in a pipeline upstream of the high-pressure valve; mounting a standpipe pressure sensor on a pipeline connecting the high-pressure valve and a standpipe for detecting mud pressure P2 (unit: MPa) in a pipeline downstream of the high-pressure valve;

2) setting a judgement constant N (unit: MPa) according to the average value of the difference between the mud pressures in the pipelines upstream and downstream of the high-pressure valve under a normal operating condition;

3) at the start of the drilling pump, obtaining, by a controller, the mud pressure P1 in the pipeline upstream of the high-pressure valve and the mud pressure P2 in the pipeline downstream of the high-pressure valve, and comparing the mud pressure P1 and the mud pressure P2 in real time:

if $P1-P2<N$, judging that the high-pressure valve is in an open state, and the drilling pump is able to operate normally;

if $P1-P2>N$, judging that the high-pressure valve is in a closed state, and the continuous operation of the drilling pump will cause the occurrence of pump suffocation.

When it is detected that the high-pressure valve is in the closed state and pump suffocation of the drilling pump may occur, an early warning is given in time.

The average value of the difference between the mud pressures in the pipelines upstream and downstream of the high-pressure valve under the normal operating condition is set as n (unit: MPa). The average value n is generally greater than 0 and smaller than 1 MPa. $1\geq N-n\leq 3$ (unit: MPa) is set in combination with parameters of used drilling equipment.

In drilling production, the operating pressure Pn of the drilling pump is designed according to the designed well depth and bottom layer pressure of each well. The normal operating pressure range of Pn is 3 Mpa-35 MPa, preferably 15-35 MPa. In order to prevent the situation that the pump pressure of the drilling pump is abnormally ultra-high due to operation error or drilling bit nozzle blockage, a protection value Pn+c (c is a constant, which is generally 1-3) is required to be set to prevent the abnormally ultra-high pump pressure in actual work. If the operating pressure P of the drilling pump obtained during real-time monitoring is $\geq Pn+c$, it is required to relieve the pressure in time to prevent the potential safety hazard from being caused by the continuous increase of the pump pressure.

According to the parameters of the drilling equipment commonly used at home and abroad, it can be seen that, when the mud pumped out of the drilling pump flows and transfers pressure in the high-pressure pipeline, there is a pressure difference between the mud pressure in the standpipe and the mud pressure at the discharge line of the drilling pump due to the resistance, but the mud difference of both generally does not exceed 1 MPa. On the contrary, if the high-pressure valve of the drilling pump is closed, when the drilling pump starts, the difference between the mud pressure at the discharge line of the pump and the mud pressure in the standpipe will be far greater than 1 MPa. By taking advantage of this characteristic, whether the high-pressure valve is in the open state or closed state can be determined. The pressure signal value of a pressure sensor 3 is set as P1 and the pressure signal valve of a pressure sensor 5 is set as P2, then P1−P2 is smaller than 1 MPa or P2−P1 is smaller than 1 MPa. The closer the distance of the mounting position of the pressure sensor 5 to a high-pressure valve 2 is, the smaller the difference of P1−P2 or P2−P1 is. Considering the fluctuation of the pressure of the mud liquid and the error of signal values acquired by the pressure sensor 3 and the pressure sensor 5, the average value n of the difference between the mud pressures in the pipelines upstream and downstream of the high-pressure valve may be slightly enlarged to a constant N (it may be set according to the site conditions and satisfies $1 \leq N-n \leq 3$), and then whether pump suffocation of the drilling pump occurs can be determined according to the difference between the pressures upstream and downstream of the high-pressure valve in the high-pressure pipeline of the drilling pump.

EXAMPLE 2

The application provides a pump pressure protection system for preventing pump suffocation of a drilling pump in petroleum drilling engineering, which includes a pump pressure sensor configured to detect mud pressure (i.e., pump outlet pressure) P1 (unit: MPa) in a pipeline upstream of a high-pressure valve; a standpipe pressure sensor configured to detect mud pressure P2 (unit: MPa) in a pipeline downstream of the high-pressure valve; a controller configured to obtain the mud pressure P1 in the pipeline upstream of the high-pressure valve and the mud pressure P2 in the pipeline downstream of the high-pressure valve, and to compare the mud pressure P1 and the mud pressure P2 in real time, wherein a judgement constant N is set according to the average value of the difference between the mud pressures in the pipelines upstream and downstream of the high-pressure valve under a normal operating condition: (1) if P1−P2≤N, judging that the high-pressure valve is in an open state, and the drilling pump operates normally; (2) if P1−P2>N, judging that the high-pressure valve is in a closed state, and the continuous operation of the drilling pump will cause the occurrence of pump suffocation; a pressure relief valve connected to the pipeline upstream of the high-pressure valve and located between the drilling pump and a mud tank; and an actuating mechanism including a pneumatic control loop and a solenoid valve and used to operate the drilling pump and the pressure relief valve after receiving an instruction from the controller, wherein output pressure signals of the pump pressure sensor and the standpipe pressure sensor are optionally transmitted to the controller through an analog-digital (AD) converter, and an output of the controller is then transmitted to the actuating mechanism, and power of the pressure relief valve and the drilling pump is controlled through the actuating mechanism.

The pressure relief valve is preferably a pneumatic ball valve. The controller may be an industrial personal computer or a combination of an industrial personal computer and a Programmable Logic Controller (PLC). The solenoid valve is preferably a two-position five-way solenoid valve.

The pump pressure protection system adopts the monitoring and judging system in Example 1 to identify the occurrence of pump suffocation of the drilling pump to further stop the drilling pump for pressure relief through the pump pressure protection system of the drilling pump, so as to prevent pump suffocation of the drilling pump from occurring. Specifically, at the start of the drilling pump, the controller obtains the pump outlet pressure P1 and the mud pressure P2 in the pipeline downstream of the high-pressure valve and compares the pump outlet pressure P1 and the mud pressure P2 in real time:

If P1−P2≤N, judging that the high-pressure valve is in an open state, and the drilling pump is able to operate normally. At this moment, what needs to be prevented is the problem that the pump pressure during drilling is ultra-high. Therefore, an upper limit P (unit: MPa) for pump pressure protection is set. If the pump outlet pressure P1 and/or the mud pressure P2 in the pipeline downstream of the high-pressure valve is greater than or equal to P, the pump pressure protection system of the drilling pump opens the pressure relief valve and correspondingly powers off the drilling pump;

If P1−P2>N, judging that the high-pressure valve is in a closed state, and pump suffocation of the drilling pump occurs. At this moment, what needs to be prevented is the problem that the drilling pump is started without opening the high-pressure valve, so as to prevent a pump seizure accident due to suffocation from occurring. The controller starts the pump pressure protection system to open the pressure relief valve and correspondingly power off the drilling pump to stop the drilling pump for pressure relief, so as to prevent a pump seizure accident due to suffocation from occurring.

EXAMPLE 3

Referring to FIG. 1, it illustrates a structural schematic diagram of a pump pressure protection system for preventing pump suffocation of a drilling pump according to the application. A pump pressure protection system for preventing pump suffocation of a drilling pump in petroleum drilling engineering may include a pump outlet pressure sensor P1 (unit: MPa), a mud pressure sensor P2 (unit: MPa) downstream of the high-pressure valve, a pressure relief valve, a controller and a pneumatic control system, wherein output pressure signals of the pump outlet pressure sensor P1 and the mud pressure sensor P2 downstream of the high-pressure valve are connected to the controller, an output control of the controller is connected with a solenoid valve, and power of the pressure relief valve and the drilling pump is controlled through the solenoid valve.

A pressure sensor 3 is mounted on a discharge line between the drilling pump 1 and a high-pressure valve 2, a pressure sensor 5 is mounted on a high-pressure pipeline between the high-pressure valve 2 and a standpipe 4, a PLC 6 acquires the signal values of the pressure sensor 3 and the pressure sensor 5 in real time through an AD converter 7, and an industrial personal computer 8 analyzes the acquired pressure signal values according to a set program and makes a judgement. If the pressure is abnormal, the industrial personal computer 8 sends out an instruction to make a two-position five-way solenoid valve 10 act, and the system automatically cut off the power source of the drilling pump 1 to stop it, and simultaneously opens a pneumatic ball valve 9 mounted on a low-pressure return water pipeline to relieve pressure.

If P1−P2≤N, judging that the high-pressure valve 2 is in an open state, and the drilling pump is able to operate normally. At this moment, what needs to be prevented is the problem that the pump pressure is ultra-high during drilling, i.e., to prevent P≥Pn+c. If the signal value P1 of the pressure sensor 3 or the signal value P2 of the pressure sensor 5 is greater than or equal to Pn+c, the industrial personal computer 8 sends out an instruction to make the two-position five-way solenoid valve 10 act, and the system will automatically cut off the power source of the drilling pump 1 to stop it, and simultaneously opens the pneumatic ball valve 9 mounted on the low-pressure return water pipeline to relieve pressure, so as to achieve the purpose of stopping the pump to relieve pressure and remove the potential hazard.

If P1−P2>N, judging that the high-pressure valve 2 is in a closed state. At this moment, what needs to be prevented is the dangerous operation of starting the drilling pump 1 without opening the high-pressure valve 2, i.e., to prevent the pump seizure accident due to suffocation from occurring. The industrial personal computer 8 sends out an instruction to make the two-position five-way solenoid valve 10 act, the system automatically cuts off the power source of the drilling pump 1 to stop it, and simultaneously opens the pneumatic ball valve 9 mounted on the low-pressure return water pipeline to relieve pressure, so as to achieve the purpose of preventing the pump seizure accident due to suffocation from occurring.

EXAMPLE 4

The application provides a method for preventing misoperation of a drilling pump in petroleum drilling engineering, the implementation process of which includes the following steps:

1) mounting pressure sensor on a standpipe for detecting mud pressure P0 in the standpipe;

2) mounting a first pressure sensor I on a discharge line of a drilling pump I for detecting pressure P1 (unit: MPa) of the drilling pump I;

3) mounting a second pressure sensor II on a discharge line of a drilling pump II for detecting pressure P2 (unit: MPa) of the drilling pump II;

4) setting the average value of the difference between mud pressure in pipelines upstream and downstream of a high-pressure valve under a normal operating condition as n (unit: MPa), wherein the average value is generally greater than 0 and smaller than 1 MPa. A constant N is set in combination with parameters of used drilling equipment, wherein the constant N satisfies 1≤N−n≤3;

5) at the start of the drilling pump, obtaining, by a controller, the mud pressure P0 in the standpipe, the pressure P1 of the drilling pump I and the pressure P2 of the drilling pump II, and comparing them in real time:

if P0−P1≤N, or P2−P1≤N and P0−P1≤N, judging that the high-pressure valve of the drilling pump I is in an open state, and the drilling pump I is able to start;

if P0−P2≤N, or P1−P2≤N and P0−P2≤N, judging that the high-pressure valve of the drilling pump II is in an open state, and the drilling pump II is able to start;

if P0−P1>N, or P2−P1>N and P0−P1>N, judging that the high-pressure valve of the drilling pump I is in a closed state, and the controller controls (for example, cuts off) a control air path or circuit of the drilling pump I to make the drilling pump I unable to start;

if P0−P2>N, or P1−P2>N and P0−P2>N, judging that the high-pressure valve of the drilling pump II is in a closed state, and the controller controls (for example, cuts off) a control air path or circuit of the drilling pump II to make the drilling pump II unable to start.

In the method for preventing pump suffocation of the drilling pump in petroleum drilling engineering, when it is detected that the high-pressure valve is in the closed state and pump suffocation of the drilling pump occurs, an early warning is given in time.

EXAMPLE 5

The application provides a pump pressure protection system for preventing misoperation of a drilling pump in petroleum drilling engineering, which includes a standpipe pressure sensor, a controller and an actuating mechanism, wherein a drilling pump I and a drilling pump II correspondingly used as a normally operating drilling pump and a standby drilling pump are respectively provided with a pump pressure detection sensor, output signals of the standpipe pressure sensor and the pump pressure detection sensor are respectively connected to the controller through an AD converter, two loops of control mechanism outputs connected with the controller are provided and respectively control start and stop control circuits connected with the drilling pump I and the drilling pump II, the controller identifies the occurrence of misoperation of the drilling pump by adopting the method according to claim 1 and controls the start and stop of the drilling pump I or the drilling pump II through corresponding control mechanisms, so as to prevent pump suffocation caused by misoperation of the drilling operation from occurring.

EXAMPLE 6

Referring to FIG. 2, it illustrates a structural schematic diagram of a pump pressure protection system for preventing pump suffocation of a drilling pump (mechanical drilling pump) according to the application. A pump pressure protection system for preventing misoperation of a drilling pump in petroleum drilling engineering may include a standpipe pressure sensor configured to detect pressure P0 (unit: MPa) in a standpipe; pump pressure sensors including a first pressure sensor and a second pressure sensor, the first pressure sensor being configured to detect pressure P1 (unit: MPa) of a drilling pump I, the second pressure sensor being configured to detect pressure P2 (unit: MPa) of a drilling pump II; a controller configured to obtain the pressure P0 in the standpipe, the pressure P1 of the drilling pump I and the pressure P2 of the drilling pump II, and to compare the pressure P0, the pressure P1 of the drilling pump I and the pressure P2 of the drilling pump II in real time, wherein the average value of the difference between mud pressures in pipelines upstream and downstream of a high-pressure valve under a normal operating condition is set as n, a judgement constant N is set in combination with parameters of used drilling equipment, and the judgement constant N satisfies 1≤N−n≤3; (1) if P0−P1≤N, or P2−P1≤N and P0−P1≤N, judging that the high-pressure valve of the drilling pump I is in an open state, and the drilling pump I starts; (2) if P0−P2≤N, or P1−P2≤N and P0−P2≤N, judging that the high-pressure valve of the drilling pump II is in an open state, and the drilling pump II starts; (3) if P0−P1>N, or P2−P1>N and P0−P1>N, judging that the high-pressure valve of the drilling pump I is in a closed state, and the controller controls (for example, cuts off) a control air path of the drilling pump Ito make the drilling pump I unable to start; (4) if P0−P2>N, or P1−P2>N and P0−P2>N, judging that the high-pressure valve of the drilling pump II is in a closed state, and the controller controls (for example, cuts off) a control air path of the drilling pump II to make the drilling pump II unable to start; and an actuating mechanism which may includes a pneumatic control system and a solenoid valve, and is configured to operate the drilling pump I and the drilling pump II after receiving an instruction from the controller, wherein output pressure signals of the pump pressure sensor and the standpipe pressure sensor are optionally transmitted to the controller through an analog digital (AD) converter, and an output of the controller is then transmitted to the actuating mechanism, and the start and stop of the drilling pump I or the drilling pump II is controlled through the actuating mechanism, so as to prevent pump suffocation due to misoperation of the drilling pump from occurring.

The controller outputs two loops of control signals which are respectively connected with a control solenoid valve of the drilling pump I and a control solenoid valve of the drilling pump II, and then are respectively connected with clutch controllers of the drilling pumps through the solenoid valves.

The controller may be an industrial personal computer or a combination of an industrial personal computer and a Programmable Logic Controller (PLC). The solenoid valve is preferably a two-position five-way solenoid valve.

The pump pressure protection system adopts the monitoring and judging method in Example 5 to identify the occurrence of misoperation of the drilling pump to control the start and stop of the drilling pump I or the drilling pump II through the pump pressure protection system of the drilling pump, so as to prevent pump suffocation due to misoperation of the drilling pump from occurring. Specifically, at the start of the drilling pump, the controller obtains the pressure P0 in the standpipe, the pressure P1 of the drilling pump I and the pressure P2 of the drilling pump II, and compares the pressure P0, the pressure P1 of the drilling pump I and the pressure P2 of the drilling pump II in real time:

if P0−P1≤N, or P2−P1≤N and P0−P1≤N, judging that the high-pressure valve of the drilling pump I is in an open state, and the drilling pump I is able to start;

if P0−P2≤N, or P1−P2≤N and P0−P2≤N, judging that the high-pressure valve of the drilling pump II is in an open state, and the drilling pump II is able to start;

if P0−P1>N, or P2−P1>N and P0−P1>N, judging that the high-pressure valve of the drilling pump I is in a closed state, and the controller controls (for example, cuts off) a control air path of the drilling pump Ito make the drilling pump I unable to start;

if P0−P2>N, or P1−P2>N and P0−P2>N, judging that the high-pressure valve of the drilling pump II is in a closed state, and the controller controls (for example, cuts off) a control air path of the drilling pump II to make the drilling pump II unable to start.

EXAMPLE 7

Referring to FIG. 3, it illustrates a structural schematic diagram of a pump pressure protection system for preventing pump suffocation of a drilling pump (electric drilling pump) according to the application. A pump pressure protection system for preventing misoperation of a drilling pump in petroleum drilling engineering may include a standpipe pressure sensor configured to detect pressure P0 (unit: MPa) in a standpipe; pump pressure sensors including a first pressure sensor and a second pressure sensor, the first pressure sensor being configured to detect pressure P1 (unit: MPa) of a drilling pump I, the second pressure sensor being configured to detect pressure P2 (unit: MPa) of a drilling pump II; a controller configured to obtain the pressure P0 in the standpipe, the pressure P1 of the drilling pump I and the pressure P2 of the drilling pump II, and compare the pressure P0, the pressure P1 of the drilling pump I and the pressure P2 of the drilling pump II in real time, wherein the average value of the difference between mud pressures in pipelines upstream and downstream of a high-pressure valve under a normal operating condition is set as n (unit: MPa), wherein n is generally greater than 0 and smaller than 1 MPa. A judgement constant N is set in combination with parameters of adopted drilling equipment, and the judgement constant N satisfies 1≤N−n≤3, (1) if P0−P1≤N, or P2−P1≤N and P0−P1≤N, judging that the high-pressure valve of the drilling pump I is in an open state, and the drilling pump I starts; (2) if P0−P2≤N, or P1−P2≤N and P0−P2≤N, judging that the high-pressure valve of the drilling pump II is in an open state, and the drilling pump II starts; (3) if P0−P1>N, or P2−P1>N and P0−P1>N, judging that the high-pressure valve of the drilling pump I is in a closed state, and the controller controls (for example, cuts off) a control circuit of the drilling pump Ito make the drilling pump I unable to start; (4) if P0−P2>N, or P1−P2>N and P0−P2>N, judging that the high-pressure valve of the drilling pump II is in a closed state, and the controller controls (for example, cuts off) a control circuit of the drilling pump II to make the drilling pump II unable to start; and an actuating mechanism which may includes an electric control loop and a start and stop control circuit and is configured to operate the drilling pump I and the drilling pump II after receiving an instruction from the controller, wherein output pressure signals of the pump pressure sensor and the standpipe pressure sensor are optionally transmitted to the controller through an analog digital (AD) converter, and an output of the controller is then transmitted to the actuating mechanism, and the start and stop of the drilling pump I or the drilling pump II is controlled through the actuating mechanism, so as to prevent pump suffocation due to misoperation of the drilling pump from occurring.

Continuously referring to FIG. 3, the pump pressure protection system for preventing misoperation of the drilling pump in petroleum drilling engineering in the present Example has the following difference from Example 6: for an electric drilling pump, the actuating mechanism is an electric control system, and the controller outputs two loops of control signals which are respectively connected with a start and stop control circuit of the drilling pump I and a start and stop control circuit of the drilling pump II.

In the pump pressure protection system for preventing misoperation of the drilling pump in petroleum drilling engineering, the controller may be an industrial personal computer or a combination of an industrial personal computer and a programmable logic controller, an output signal of the standpipe pressure sensor is connected to a main board of the industrial personal computer or the programmable logic controller through the AD converter, and a switching output board of the industrial personal computer or the Programmable Logic Controller outputs a switching-control signal. A sound alarm circuit is connected with the switching output board of the industrial personal computer or an output control end of the programmable logic controller, which can realize early warning under a dangerous situation.

The pressure sensor 1 of the drilling pump 1 (No. 1 mud pump) and the pressure sensor 2 of the drilling pump 2 (No. 2 mud pump) acquire the mud pressure signals in the mud pump outlet pipelines in real time and transmit them to the AD converter; the standpipe pressure sensor acquires the mud pressure signal in the standpipe in real time and transmits it to the AD converter; the "speed-regulating hand wheel" which controls the start, stop and running speed of the mud pumps acquires the voltage signal generated by the rotary hand wheel for the driller in real time and transmits it to the AD converter; the AD converter converts the acquired analog signals into digital signals and transmits them to the PLC, the PLC transmits the calculation result to the industrial personal computer through program operation, the industrial personal computer determines whether there is misoperation according to the set parameters; if there is no misoperation, the industrial personal computer sends out a control instruction to the PLC and connects the power transmission system of the mud pump through the PLC to make it operate normally; if there is misoperation, the industrial personal computer sends out a control command to the PLC to cut off the power transmission system of the mud pump to stop the mud pump. In this way, the safety protection in case of emergency is realized.

For the purposes of this description, certain aspects, advantages and novel features of the embodiments of the disclosure are described herein. The disclosed methods, devices and systems shall not be interpreted as limitations in any way. In addition, the disclosure relates to all novel and non-obvious features and aspects of each, various combinations and sub-combinations of the disclosed embodiments. The methods, devices, and systems are not limited to any specific aspect or feature or combination thereof, and the disclosed embodiments do not require the existence of any one or more specific advantages or problems to be solved. Even if not described together, the features and characteristics of one embodiment may be combined with the features and characteristics of another embodiment.

Although some of the operations in the disclosed embodiments are described in a specific sequential order for convenience of introduction, it should be understood that such description includes rearrangement, unless the specific language described below requires specific ordering. For example, the operations described in turn may be rearranged or performed simultaneously in some cases. Moreover, for the sake of simplicity, the drawings may not illustrate various ways in which the disclosed methods may be used in combination with other methods, and the various steps may be combined in various ways even if not described together. In addition, the description sometimes uses terms such as "provide" or "implement" to describe the disclosed methods. These terms are high-level abstractions of the actual operations that are performed. The actual operation corresponding to these terms may be changed according to the specific implementation modes, and may be easily known by those skilled in the art.

In view of the many possible embodiments in which the principles of the disclosure may be applied, it should be known that the described embodiments are only preferred examples and should not be considered as limitations to the scope of the disclosure. On the contrary, the scope of the disclosure should be limited by the attached claims.

The invention claimed is:

1. A monitoring and judging method for a pump suffocation of a drilling pump in petroleum drilling engineering, comprising:

mounting a pump pressure sensor on a pipeline connecting a discharge line of the drilling pump and a high-pressure valve for detecting mud pressure P1 in a pipeline upstream of the high-pressure valve;

mounting a standpipe pressure sensor on a pipeline connecting the high-pressure valve and a standpipe for detecting mud pressure P2 in a pipeline downstream of the high-pressure valve;

setting a judgment constant N based on an average value of the difference between mud pressures in the pipelines upstream and downstream of the high-pressure valve in a normal operating condition; and obtaining, by a controller, the mud pressure P1 in the pipeline upstream of the high-pressure valve and the mud pressure P2 in the pipeline downstream of the high-pressure valve when the drilling pump is started, and comparing the mud pressure P1 with the mud pressure P2 in real time, wherein:

if $P1-P2 \leq N$, judging that the high-pressure valve is in an open state; and if $P1-P2 > N$, judging that the high-pressure valve is in a closed state.

2. The monitoring and judging method for the pump suffocation of a drilling pump in petroleum drilling engineering according to claim 1, wherein when it is determined that the high-pressure valve is in an open state, the drilling pump operates normally;

and when it is determined that the high-pressure valve is in a closed state, a continuous operation of the drilling pump causes pump pressure to rise rapidly, resulting in an occurrence of pump suffocation, and wherein an average value of the difference between the mud pressures in the pipelines upstream and downstream of the high-pressure valve in the normal operating condition is set as n, and $1 \leq N-n \leq 3$ is set according to[[ the]] drilling equipment parameters used.

3. A pump pressure protection system for preventing a drilling pump from pump suffocation in petroleum drilling engineering, which identifies the occurrence of the pump suffocation of the drilling pump by the monitoring and judging method according to claim 1 to further stop the drilling pump for pressure relief through the pump pressure protection system of the drilling pump, wherein:

when the drilling pump is started, a controller obtains pump outlet pressure P1 and mud pressure P2 in a pipeline downstream of a high-pressure valve, and compares the pump outlet pressure P1 with the mud pressure P2 in real time, wherein:

if $P1-P2 \leq N$, judging that the high-pressure valve is in an open state, and then setting an upper limit P for pump pressure protection;

if the pump outlet pressure P1 or/and the mud pressure P2 in the pipeline downstream of the high-pressure valve is greater than or equal to P, starting, by the pump pressure protection system of the drilling pump, a pressure relief valve and correspondingly shutting off the drilling pump;

if $P1-P2 > N$, judging that the high-pressure valve is in a closed state, and then starting, by the controller, the pump pressure protection system to open the pressure relief valve and correspondingly shutting off the drilling pump to stop the drilling pump for pressure relief.

4. The pump pressure protection system according to claim 3, comprising a pump outlet pressure sensor P1, a mud pressure sensor P2 downstream of the high-pressure valve, a pressure relief valve, a controller and a pneumatic control system, wherein output pressure signals of the pump outlet pressure sensor P1 and the mud pressure sensor P2 downstream of the high-pressure valve are transmitted to the controller, and an output control of the controller is connected to a solenoid valve by which power for the pressure relief valve and for the drilling pump is controlled.

5. The pump pressure protection system according to claim 3, wherein when it is determined that the high-pressure valve is in an open state, the drilling pump operates normally;

and when it is determined that the high-pressure valve is in a closed state, the continuous operation of the drilling pump causes pump pressure to rise rapidly, resulting in the occurrence of pump suffocation, and wherein an average value of the difference between the mud pressures in the pipelines upstream and downstream of the high-pressure valve in the normal operating condition is set as n, and $1 \leq N-n \leq 3$ is set according to the drilling equipment parameters used.

6. A pump pressure protection system for preventing a drilling pump from pump suffocation in petroleum drilling engineering, comprising:

a pump pressure sensor configured for detecting mud pressure P1 in a pipeline upstream of a high-pressure valve;

a standpipe pressure sensor configured for detecting mud pressure P2 in a pipeline downstream of the high-pressure valve;

a controller configured for obtaining the mud pressure P1 in the pipeline upstream of the high-pressure valve and the mud pressure P2 in the pipeline downstream of the high-pressure valve, and for comparing the mud pressure P1 with the mud pressure P2 in real time, wherein a judgment constant N is set based on an average value of the difference between the mud pressures in the pipelines upstream and downstream of the high-pressure valve in a normal operating condition such that: (1) if $P1-P2 \leq N$, it is judged that the high-pressure valve is in an open state; and (2) if $P1-P2>N$, it is judged that that the high-pressure valve is in a closed state;

a pressure relief valve coupled to the pipeline upstream of the high-pressure valve and between the drilling pump and a mud tank; and an actuating mechanism comprising a pneumatic control loop and a solenoid valve, for operating the drilling pump and the pressure relief valve upon receiving an instruction from the controller.

7. The pump pressure protection system according to claim 6, wherein the pressure relief valve is a pneumatic ball valve, the controller is an industrial personal computer or a combination of an industrial personal computer and a programmable logic controller (PLC), and the solenoid valve is a two-position five-way solenoid valve.

8. The pump pressure protection system according to claim 6, wherein output pressure signals of the pump pressure sensor and the standpipe pressure sensor are transmitted to the controller via an AD converter, and an output of the controller is transmitted in turn to the actuating mechanism by which power for the pressure relief valve and for the drilling pump is controlled.

9. A method for preventing misoperation of a drilling pump in petroleum drilling engineering, comprising:

mounting a standpipe pressure sensor on a standpipe for detecting mud pressure P0 in the standpipe;

mounting a first pressure sensor on a discharge line of a drilling pump I for detecting pressure P1 of the drilling pump I;

mounting a second pressure sensor on a discharge line of a drilling pump II for detecting pressure P2 of the drilling pump II;

setting an average value of the difference between mud pressures in the pipelines upstream and downstream of a high-pressure valve in a normal operating condition as n, and setting a judgment parameter N according to drilling equipment parameters used, the judgment parameter N satisfying $1 \leq N-n \leq 3$;

obtaining, by a controller, the mud pressure PO in the standpipe, the pressure P1 of the drilling pump I and the pressure P2 of the drilling pump II when the drilling pump is started, and comparing the mud pressure P0, the pressure P1 of the drilling pump I and the pressure P2 of the drilling pump II in the following ways:

if $P0-P1 \leq N$, or $P2-P1 \leq N$ and $P0-P1 \leq N$, judging that the high-pressure valve of the drilling pump I is in an open state, the drilling pump I is started;

if $P0-P2 \leq N$, or $P1-P2 \leq N$ and $P0-P2 \leq N$, judging that the high-pressure valve of the drilling pump II is in an open state, the drilling pump II is started;

if $P0-P1>N$, or $P2-P1>N$ and $P0-P1>N$, judging that the high-pressure valve of the drilling pump I is in a closed state, the controller controls a control air path or circuit of the drilling pump I such that the drilling pump I cannot be started;

if $P0-P2>N$, or $P1-P2>N$ and $P0-P2>N$, judging that the high-pressure valve of the drilling pump II is in a closed state, the controller controls a control air path or circuit of the drilling pump II such that the drilling pump II cannot be started.

10. The method for preventing misoperation of a drilling pump in petroleum drilling engineering according to claim 9, wherein when it is detected that the high-pressure valve of the drilling pump I or the drilling pump II is in the closed state, an early warning is given in time.

11. A pump pressure protection system for preventing misoperation of a drilling pump in petroleum drilling engineering, comprising a standpipe pressure sensor, a controller and an actuating mechanism, wherein a drilling pump I and a drilling pump II served as a common drilling pump and a standby drilling pump, respectively, are each provided with a pump pressure detection sensor, output signals of the standpipe pressure sensor and the pump pressure detection sensor are separately transmitted to the controller via an AD converter, the controller is connected with two control mechanism outputs which control and connect start and stop control circuits of the drilling pump I and the drilling pump II, respectively, the controller identifies the occurrence of misoperation of the drilling pump by the method according to claim 9 and controls the start and stop of the drilling pump I or the drilling pump II via a respective control mechanism.

12. The pump pressure protection system for preventing misoperation of a drilling pump in petroleum drilling engineering according to claim 11, wherein, for a mechanical drilling pump, the actuating mechanism is a pneumatic control system, and the controller outputs two control signals which connect a control solenoid valve of the drilling pump I and a control solenoid valve of the drilling pump II, respectively, and which connect clutch controllers of the drilling pump I and the drilling pump II through control solenoid valves of the drilling pump I and the drilling pump II, respectively.

13. The pump pressure protection system for preventing misoperation of a drilling pump in petroleum drilling engineering according to claim 12, wherein the controller is an industrial personal computer or a combination of an industrial personal computer and a programmable logic controller, an output signal of the standpipe pressure sensor is transmitted to a main board of the industrial personal computer or to the programmable logic controller via the AD converter, and a switching output board of the industrial personal computer or the programmable logic controller outputs and controls a switch signal; an output control terminal of the switching output board of the industrial personal computer or the programmable logic controller is connected with a sound alarm circuit.

14. The pump pressure protection system for preventing misoperation of a drilling pump in petroleum drilling engineering according to claim 11, wherein, for an electric drilling pump, the actuating mechanism is an electric control system, and the controller outputs two control signals which connect a start and stop control circuit of the drilling pump I and a start and stop control circuit of the drilling pump II, respectively.

15. The pump pressure protection system for preventing misoperation of a drilling pump in petroleum drilling engineering according to claim 14, wherein the controller is an industrial personal computer or a combination of an industrial personal computer and a programmable logic controller, an output signal of the standpipe pressure sensor is transmitted to a main board of the industrial personal computer or to the programmable logic controller via the AD converter, and a digital output module of the industrial personal computer or the programmable logic controller outputs and controls a switch signal; an output control terminal of the digital output module of the industrial personal computer or the programmable logic controller is connected with a sound alarm circuit.

16. A pump pressure protection system for preventing misoperation of a drilling pump in petroleum drilling engineering, comprising:

a standpipe pressure sensor configured for detecting pressure P0 in a standpipe;

a pump pressure sensor comprising a first pressure sensor and a second pressure sensor, the first pressure sensor being configured for detecting pressure P1 of a drilling pump I, and the second pressure sensor being configured for detecting pressure P2 of a drilling pump II;

a controller configured for obtaining the pressure P0 in the standpipe, the pressure P1 of the drilling pump I and the pressure P2 of the drilling pump II, and for comparing the pressure P0, the pressure P1 of the drilling pump I and the pressure P2 of the drilling pump II in real time, wherein an average value of the difference between mud pressures in the pipelines upstream and downstream of a high-pressure valve in a normal operating condition is set as n, and a judgment parameter N is set according to the drilling equipment parameters used, the judgment parameter N satisfying $1 \leq N-n \leq 3$: (1) if $P0-P1 \leq N$, or $P2-P1 \leq N$ and $P0-P1 \leq N$, judging that the high-pressure valve of the drilling pump I is in an open state, so that the drilling pump I is started; (2) if $P0-P2 \leq N$, or $P1-P2 \leq N$ and $P0-P2 \leq N$, judging that the high-pressure valve of the drilling pump II is in an open state, the drilling pump II is started; (3) if $P0-P1>N$, or $P2-P1>N$ and $P0-P1>N$, judging that the high-pressure valve of the drilling pump I is in a closed state, the controller controls a control air path or circuit of the drilling pump I such that the drilling pump I cannot be started; (4) if $P0-P2>N$, or $P1-P2>N$ and $P0-P2>N$, judging that the high-pressure valve of the drilling pump II is in a closed state, the controller controls a control air path or circuit of the drilling pump II such that the drilling pump II cannot be started; and an actuating mechanism comprising a pneumatic control system and a solenoid valve, or comprising an electric control loop and a start and stop control circuit, for operating the drilling pump I and the drilling pump II upon receiving an instruction from the controller.

17. The pump pressure protection system for preventing misoperation of a drilling pump in petroleum drilling engineering according to claim 16, wherein, for a mechanical drilling pump, the actuating mechanism is a pneumatic control system, and the controller outputs two control signals which connect a control solenoid valve of the drilling pump I and a control solenoid valve of the drilling pump II, respectively, and which connect the clutch controllers of the drilling pump I and the drilling pump II through the control solenoid valves of the drilling pump I and the drilling pump II, respectively.

18. The pump pressure protection system for preventing misoperation of a drilling pump in petroleum drilling engineering according to claim 16, wherein, for an electric drilling pump, the actuating mechanism is an electric control system, and the controller outputs two control signals which connect a start and stop control circuit of the drilling pump I and a start and stop control circuit of the drilling pump II, respectively.

19. The pump pressure protection system for preventing misoperation of a drilling pump in petroleum drilling engineering according to claim 16, wherein the controller is an industrial personal computer or a combination of an industrial personal computer and a programmable logic controller, an output signal of the standpipe pressure sensor is transmitted to a main board of the industrial personal computer or to the programmable logic controller via the AD converter, and a digital output module of the industrial personal computer or the programmable logic controller outputs and controls a switch signal; an output control terminal of the digital output module of the industrial personal computer or the programmable logic controller is connected with a sound alarm circuit.

20. The pump pressure protection system for preventing misoperation of a drilling pump in petroleum drilling engineering according to claim 16, wherein output pressure signals of the pump pressure sensor and the standpipe pressure sensor are transmitted to the controller via an AD converter, and an output of the controller is transmitted in turn to the actuating mechanism by which the start and stop of the drilling pump I or the drilling pump II is controlled.

* * * * *